United States Patent [19]

Higuchi et al.

[11] Patent Number: 4,501,802

[45] Date of Patent: Feb. 26, 1985

[54] HYDRATED CHROMIUM OXIDE-COATED STEEL STRIP USEFUL FOR WELDED CANS AND OTHER CONTAINERS

[75] Inventors: Seizun Higuchi; Tomonari Ooga; Yukio Tsukamoto; Minoru Kamada; Yukio Nomura, all of Kitakyushu, Japan

[73] Assignee: Nippon Steel Corporation, Tokyo, Japan

[21] Appl. No.: 527,380

[22] Filed: Aug. 29, 1983

Related U.S. Application Data

[63] Continuation of Ser. No. 268,115, May 28, 1981, abandoned.

[30] Foreign Application Priority Data

| | | | |
|---|---|---|---|
| Jun. 3, 1980 | [JP] | Japan | 55-73795 |
| Jun. 7, 1980 | [JP] | Japan | 55-77015 |
| Jun. 7, 1980 | [JP] | Japan | 55-77016 |
| Jun. 7, 1980 | [JP] | Japan | 55-77017 |
| Aug. 14, 1980 | [JP] | Japan | 55-111040 |
| Aug. 14, 1980 | [JP] | Japan | 55-111041 |

[51] Int. Cl.[3] ..... C25D 5/36

[52] U.S. Cl. ..... 428/629; 428/632; 428/633; 428/646; 428/648; 428/666; 428/667; 428/679; 428/680; 220/456; 220/81 R

[58] Field of Search ..... 428/629, 632, 633, 646, 428/648, 666, 667, 679, 680; 220/456, 81 R

[56] References Cited

U.S. PATENT DOCUMENTS

| | | | |
|---|---|---|---|
| 3,860,398 | 1/1975 | Tsurumaru et al. | 428/629 |
| 3,978,803 | 9/1976 | Asano et al. | 428/626 |
| 4,035,248 | 7/1977 | Asano et al. | 428/667 |

FOREIGN PATENT DOCUMENTS

| | | | |
|---|---|---|---|
| 865187 | 7/1978 | Belgium . | |
| 36-10064 | 7/1961 | Japan . | |
| 36-15252 | 9/1961 | Japan . | |
| 55-158295 | 12/1980 | Japan | 428/629 |

OTHER PUBLICATIONS

Lyman, T., Ed. Metals Handbook, vol. 2, 8th ed., Am. Soc. Metals, 1964.

Silman, H. et al., Protective and Decorative Coatings for Metals, p. 556, 1978.

*Primary Examiner*—Veronica O'Keefe

*Attorney, Agent, or Firm*—Cushman, Darby & Cushman

[57] ABSTRACT

A hydrated chromium oxide-coated steel strip which has a satisfactory weldability and resistance to corrosion under a lacquer coating and which is useful for producing welded cans and other containers, comprises a steel strip substrate, plated nickel base layers formed on the surfaces of the steel strip substrate and having a weight of 150–2500 mg per $m^2$ of each surface of the substrate, hydrated chromium oxide-containing coating layers formed on the surfaces of the plated nickel base layers and having a weight of 2–20 mg, in terms of metallic chromium, per $m^2$ of each surface of the substrate, and, optionally, plated tin intermediate layers formed between the plated nickel base layers and the chromate-containing coating layers and having a weight of 100–2000 mg per $m^2$ of each surface of the substrate, the hydrated chromium oxide-containing coating layer optionally being composed of a metallic chromium underlayer in a weight of 10 mg or less per $m^2$ of each surface of the steel strip substrate and a hydrated chromium oxide upper layer, the sum of the weights of the underlayer and the upper layer being 2–20 mg, in terms of metallic chromium, per $m^2$ of each surface of the steel strip substrate.

5 Claims, No Drawings

HYDRATED CHROMIUM OXIDE-COATED STEEL STRIP USEFUL FOR WELDED CANS AND OTHER CONTAINERS

This is a continuation of application Ser. No. 268,115, filed May 28, 1981, now abandoned.

FIELD OF THE INVENTION

The present invention relates to a hydrated chromium oxide-coated steel strip useful for welded cans and other containers. More particularly, the present invention relates to a hydrated chromium oxde-coated steel strip useful for welded cans and other containers, which exhibits an excellent weldability, lacquer-bonding property and resistance to corrosion under lacquer coating.

BACKGROUND OF THE INVENTION

In recent years, various processes for producing cans and other containers have been developed. Especially, a process for producing cans and containers by seam-welding a steel strip by means of an electric resistance welding method; for example, using a Soudronic Welder, has been remarkably developed.

In order to use a steel strip for producing cans and containers, it is necessary that the steel strip exhibits an excellent workability and weldability and a satisfactory resistance to corrosion, and resistance to corrosion under lacquer coating.

In the conventional processes, the welded cans and containers are produced from a tin-plated steel strip, that is, so called tin plate, or a hydrated chromium oxide-coated steel strip which is prepared by electrolytically treating a steel strip substrate with chromic acid. The latter type of hydrated chromium oxide-coated steel strip is so-called TFS strip (tin-free steel strip).

However, the above-mentioned tin-plated steel strip exhibits the following disadvantages in the welded can or container-producing process using the electric resistance welding method.

1. It is expected that the use of the tin-plated steel strip causes the cost of producing the welded can or container to the reduced. However, since the tin-plated steel strip is not so economical, the reduction in the canor container-producing cost is unsatisfactory.

2. Also, it is expected that the tin-plated steel strip causes the appearance of the seam portion of the welded can or container to be satisfactory because, the appearance thereof is symmetrical. However, since the welding procedure applied to the tin-plated steel strip causes an undesirable iron-tin alloy layer to be produced in the heat-affected zone in the weld and the surface of the plated tin layer is remarkably oxidized, the surface of the plated tin layer is discolored and the lacquer-bonding property of the plated tin layer is degraded.

The coating layer in the TFS strip consists of metallic chromium and hydrated chromium oxides. Also, it is known that the TFS strip can be produced at a relatively low cost. However, the metallic chromium and the hydrated chromium oxides in the coating layer cause the weldability of the TFS strip to be poor. When a can is produced by welding the TFS strip, the welding strength of the weld seam portion is unsatisfactory. Also, in the welding procedure, a portion of the coated chromium and hydrated chromium oxides in the weld portion is scattered so as to stain not only the weld portion, but also the remaining portion of the can. This phenomenon results in a stained appearance on the entire surface of the can.

In order to eliminate the above-mentioned disadvantages of the TFS strip, it is necessary to mechanically remove a portion of the coating layer on the weld by means of, for example, grinding. However, since the coating layer of the TFS strip is usually composed essentially of from 70 to 150 mg of a metallic chromium underlayer per $m^2$ of each steel strip substrate surface and 10 to 30 mg of a hydrated chromium oxide upperlayer per $m^2$ of each steel strip substrate surface, it is difficult to remove the portion of the coating layer by mechanical means, for example, grinding. Also, this grinding operation applied to the TFS strip causes the coating layer to be divided into fine particles and a portion of the fine particles of one remains in the seam portion of the TFS strip to be welded so as to stain the weld on the can. Accordingly, it is difficult to obtain a welded can or container with the weld portion having a satisfactory appearance, from the conventional tin-plated steel strip or the TFS strip.

Japanese Patent Application Publication Nos. 36-15252(1961) and 36-10064(1961) disclose a coated steel strip which is plated with nickel and coated with hydrated chromium oxides and which is usable for producing containers by means of soldering.

In view of the disclosure of the Japanese patent application publications, it is clear that the coated steel strip is inadequate for the electric resistance welding procedure and, therefore, usable only for the soldering procedure.

Belgian patent No. 865,187 discloses a process for producing a coated steel strip usable for producing containers by means of electric resistance welding, in which process, a plated tin layer is formed on a surface of a steel strip substrate by means of an electrical plating, and then, heated so as to form an iron-tin alloy layer, and the tin layer surface is coated with a hydrated chromium oxide layer. However, the iron-tin alloy layer makes the formation of continuous, uniform nuggets to be difficult and causes the weldability of the coated steel strip to be poor. Also, the welding procedure applied to the coated steel strip causes the appearance of the lacquered steel strip to be poor.

Under the above-mentioned circumstances, it is strongly desired by the can- and container-producing industry to provide a hydrated chromium oxide-coated steel strip capable of being firmly welded without mechanically removing the coating layer from the portion thereof to be welded, and capable of obtaining a non-stained surface appearance of the welded portion thereof.

SUMMARY OF THE INVENTION

An object of the present invention is to provide a hydrated chromium oxide-coated steel strip useful for welded cans and other containers, which is capable of being firmly welded without preliminarily removing the coating layer from the portion of the coated steel strip to be welded by mechanical means.

Another object of the present invention is to provide a hydrated chromium oxide-coated steel strip useful for welded cans and other containers, which is capable of being firmly welded without staining and/or discloring the weld surface.

Still another object of the present invention is to provide a hydrated chromium oxide-coated steel strip useful for welded cans and other containers, which exhibits an excellent lacquer-bonding property and resistance to corrosion under the lacquer coating.

A particular object of the present invention is to provide a hydrated chromium oxide-coated steel strip useful for welded cans and other containers, which exhibits an excellent electric resistance seamweldability, even if the coating layer is not removed from the weld portion before the welding procedure.

The above-mentioned objects can be attained by the hydrated chromium oxide-coated steel strip of the present invention which is useful for producing welded cans and other containers, which comprises a steel strip substrate having two surfaces; plated nickel base layers formed on the surfaces of the steel strip substrate and having a weight of from 150 to 2500 mg per $m^2$ of each surface of the steel strip substrate and; a hydrated chromium oxide-containing coating layers formed on the plated nickel base layers and having a weight of from 2 to 20 mg, in terms of metallic chromium, per $m^2$ of each surface of the steel strip substrate.

In the hydrated chromium oxide-coated steel strip of the present invention, the hydrated chromium oxide-containing layer may consist essentially of chromate alone, or may be composed of an underlayer consisting essentially of metallic chromium in a weight of 10 mg or less per $m^2$ of each surface of the steel strip substrate and an upper layer consisting essentially of hydrated chromium oxide, the sum of the weight of the underlayer and the upper layer being in the range of from 2 to 20 mg, in terms of metallic chromium per $m^2$ of each surface of the steel strip substrate.

The hydrated chromium oxide-coated steel strip of the present invention may have an additional intermediate layer, consisting essentially of plated tin located between the plated nickel base layer and the hydrated chromium oxide-containing coating layer.

In the hydrated chromium oxide-coated steel strip of the present invention, it is preferable that in the uppermost hydrated chromium oxide layer, the molar ratio of Cr-O type oxo bonds to Cr-OH type ol bonds is 0.85 or more. Also, it is preferable that in the uppermost hydrated chromium oxide layer, the atomic ratio and/or sulfur and/or fluorine atoms to oxygen atoms is 0.15 or less.

DETAILED DESCRIPTION OF THE INVENTION

In the hydrated chromium oxide-coated steel strip of the present invention, a nickel base layer is plated on surfaces of a steel strip substrate. The plated nickel base layer is effective for enhancing the resistance to corrosion without lessening the weldability of the steel strip. The nickel plating procedure may be carried out by a conventional electroplating method and is limited neither to a special composition of a nickel plating bath nor to a special electroplating condition. Usually, the nickel electroplating procedure is carried out at a current density of from 3 to 300 $A/dm^2$ at a temperature of 70° C. or less.

For example, the nickel electroplating procedure may be carried out under the following conditions.

| Composition of plating bath: | |
|---|---|
| 300 g/l | $NiSO_4\ 6H_2O$ |
| 30 g/l | $NiCl_2\ 6H_2O$ |
| and 30 g/l | $H_3BO_3$ |
| Current density | 15 $A/dm^2$ |
| Temperature of plating bath | 40° C. |

-continued

| | |
|---|---|
| Amount of plated nickel | 400 $mg/m^2$ |
| (Thickness of nickel layer | About 0.045 microns) |

Other conditions of the nickel plating procedure are as follows.

| Composition of plating bath: | |
|---|---|
| 300 g/l | nickel sulfamate |
| 25 g/l | $H_3BO_3$ |
| Current density | 90 $A/dm^3$ |
| Temperature of plating bath | 50° C. |
| Amount of plated nickel | 900 $mg/m^2$ |
| (Thickness of nickel layer | About 0.1 microns) |

In the coated steel strip of the present invention, the amount of the plated nickel base layer is limited to the range of from 150 to 2500 $mg/m^2$, preferably, from 250 to 1000 $mg/m^2$, so as to impart a satisfactory resistance to corrosion to the steel strip but not to significantly increase the cost of producing the coated steel strip. When the amount of the nickel base layer is less than 150 $mg/m^2$, the resistance to corrosion of the resultant coated steel strip is unsatisfactory. Also, an increase in the amount of the nickel base layer to more than 2500 $mg/m^2$ is not effective for enhancing the resistance to corrosion and causes the resultant product to be expensive.

The nickel base layer may be obtained by another coating method from the electroplating method.

Generally, metallic nickel exhibits a satisfactory resistance to corrosion and has good weldability. However, the plated nickel layer always has pin holes even when the plating procedure is carried out very carefully. Therefore, in order to prevent the corrosion of the substrate material located under the nickel layer, through the pin holes and to avoid dissolving away the nickel layer itself, the nickel-plated steel strip is usually coated with a lacquer in the same manner as that applied to conventional tin-plated steel strips and TFS steel strip. In this case, it is necessary that the plated nickel layer exhibits a satisfactory lacquer-bonding property. However, usually, the plated nickel layer is covered with an oxidized nickel film having a poor lacquer-bonding property. Therefore, the lacquer cannot be firmly bonded to the plated nickel layer. Even if the lacquer is coated on a nickel-plated steel strip, when the lacquer-coated, nickel-plated steel strip is kept in contact with an aqueous liquid for a long period of time, the lacquer coating becomes easily exfoliative from the plated nickel layer and the steel strip is corroded by the aqueous liquid.

In order to eliminate the above-mentioned disadvantages of the plated nickel base layer in the coated steel strip of the present invention, a hydrated chromium oxide-containing coating layer is formed on the plated nickel base layer. The hydrated chromium oxide-containing coating layer is effective for enhancing the resistance to corrosion, the resistance to corrosion under the lacquer coating and the lacquer-bonding property.

However, usually, hydrated chromium oxide layer causes the resultant coated steel strip to exhibit a poor weldability in an electric resistance welding procedure. Accordingly, it is important that the hydrated chromium oxide-containing coating layer is formed without lessening the weldability of the nickel-plated steel strip.

Generally, the greater the thickness of the hydrated chromium oxide-containing coating layer formed on the nickel-plated steel strip, the higher the resistance to corrosion and the resistance to corrosion under the lacquer coating and the better the lacquer-bonding property. However, an increased thickness in the hydrated chromium oxide-containing coating layer results in a poor weldability of the resultant coated steel strip.

In the electric resistance welding procedure, it is desirable that the range of the welding conditions adequate for forming uniform weld nuggets and for obtaining a satisfactory welding strength, is broad. Also, in order to enhance the resistance of the weld to corrosion and to obtain a satisfactory appearance of the weld, it is necessary to prevent or minimize both the formation of undesirable splashes around the weld and the flow out of the melt from the weld during the welding procedure.

It was discovered by the inventors of the present invention that the hydrated chromium oxide-containing coating layer which is capable of enhancing the resistance to corrosion, and resistance to corrosion under the lacquer coating, also of improving the lacquer-bonding property without decreasing the weldability, should contain hydrated chromium oxide layer in an amount of from 2 to 20 mg, preferably, 3 to 15 mg, more preferably, from 5 to 10 mg, in terms of metallic chromide per $m^2$ of each surface of the steel strip substrate. When the hydrated chromium oxide layer-containing coating layer is in an amount of less than 2 mg, in terms of metallic chromium per $m^2$ of each substrate surface, the resultant product exhibits unsatisfactory resistance to corrosion and to corrosion under the lacquer coating. Also, the weight of the hydrated chromium oxide-containing coating layer is more than 20 mg, in terms of metallic chromium per $m^2$ of each surface of the substrate, the weldability of the resultant product is unsatisfactory and many splashes are formed during the welding procedure. The hydrated chromium oxide layer has a thermal insulating property and, causes the contact resistance of the weld to increase. Therefore, the larger the amount of the hydrated chromium oxdes, the poorer the weldability of the resultant product. Also, the hydrated chromium oxide layer has a poor mechanical strength and is easily crushed by applying a pressing force thereto. This phenomenon results in a local increase in current density in the weld portion and promotes the formation of splashes. Accordingly, the amount of the hydrated chromium oxide-containing layer should preferably not exceed 20 mg, more preferably, not exceed 15 mg, in terms of metallic chromium, per $m^2$ of each surface of the substrate.

The hydrated chromium oxide-containing coating layer may consist essentially of hydrated chromium oxides alone. Also, the hydrated chromium oxide-containing coating layer of the present invention may be composed of an underlayer consisting essentially of metallic chromium and an upperlayer consisting essentially of hydrated chromium oxides. The weight of the metallic chromium underlayer is 10 mg or less, preferably, 5 mg or less, per $m^2$ of each surface of the substrate and the sum of the weight of the metallic chromium underlayer and the hydrated chromium oxide upper layer is in the range of from 2 to 20 mg, preferably, from 2 to 10 mg, in terms of metallic chromium per $m^2$ of each surface of the substrate.

The metallic chromium underlayer is effective as a bonding layer between the hydrated chromium oxide upper layer and the nickel base layer. However, an excessively thick metallic chromium underlayer having a weight of 10 mg/$m^2$ results in a decrease in the weldability of the resultant product.

Also, when the sum of the weights of the metallic chromium underlayer and the hydrated chromium oxide upper layer is less than 2 mg/$m^2$, the resultant product exhibits a poor resistance to corrosion and an unsatisfactory resistance to corrosion under the lacquer coating. When the sum of the weights of the upper layer and the under layers is more than 20 mg/$m^2$, the resultant product exhibits a poor weldability and forms many splashes during the welding procedure.

In the hydrated chromium oxide-coated steel strip of the present invention, it is preferable that the outermost surface of the chromium-containing coating layer exhibits a molar ratio of Cr-O type oxo bonds to Cr-OH type ol bonds, of 0.85 or more, more preferably, 0.90 or more. That is, it is preferable that the outermost surface of the coating layer is composed mainly of $Cr^{+3}$ oxides in which chromium is mainly in the state of $Cr^{+3}$ and which has a very low degree of hydration. In this case, the coating layer exhibits an enhanced electric conductivity and therefore, the formation of splashes is prevented. Also, this type of coating layer surface contains a reduced amount of water-soluble substances. Therefore, the coating layer surface exhibits an enhanced lacquer-bonding property. Especially, the molar ratio of the oxo bonds to the ol bonds of 0.85 or more is effective for enhancing the resistance to corrosion under the lacquer coating when the lacquer coating is contacted with a corrosive aqueous liquid for a long period of time.

Furthermore, in the hydrated chromium oxide-coated steel strip of the present invention, it is preferable that the hydrated chromium oxide layer has an atomic ratio of sulfur and/or fluorine atoms to oxygen atoms, of 0.15 or less, more preferably, 0.10 or less.

This feature is effective for preventing the formation of splashes and for enhancing the lacquer-bonding property and the resistance to corrosion under the lacquer coating. Especially, the decrease in the atomic ratio of sulfur atoms to oxygen atoms, that is, the decrease in the content of $SO_4^{-2}$, which is water-soluble, in the hydrated chromium oxide layer, is remarkably effective for enhancing the resistance of the hydrated chromium oxide-coated steel strip to corrosion under the lacquer coating when it is contacted with a corrosive aqueous liquid for a long period of time.

The hydrated chromium oxide layer can be formed on the plated nickel base layer in the following manner.

After the nickel-plating procedure applied onto the steel strip substrate is completed and the surface of the plated nickel layer is cleaned up, for example, by rinsing with water, one of the following electrolytical chromic acid treatments is applied to the nickel-plated steel strip.

(1) A cathodic electrolytical treatment in which an aqueous solution of at least one member selected from chromic anhydride; water-soluble chromates, for example, sodium chromate, and potassium chromate, and; water-soluble dichromate, for example, ammonium dichromate, sodium dichromate and potassium dichromate, is used as an electrolytical treating liquid.

(2) Another cathodic electrolytical treatment in which an aqueous solution of at least one chromium-containing compound selected from chromic anhydride and water-soluble chromates and dichromates and at least one $SO_4^{-2}$-containing compound in an amount of 2.5% or less in terms of $SO_4^{-2}$, based on the weight on the chromium-containing compound, in terms of $Cr^{+6}$, is used as treating liquid.

(3) Still another cathodic electrolytical treatment in which an aqueous solution of at least one chromium-containing compound selected from chromic anhydride and water-soluble chromates and dichromates and at least one $F^-$-containing compound in an amount of 10% or less, in terms of $F^-$, based on the weight of the chromium-containing compound, in terms of $Cr^{+6}$, is used as a treating liquid.

In each type of treatment, the concentration of the chromium compound in the treating liquid is preferably in the range of from 1 to 150 g/l, more preferably, from 10 to 100 g/l. The above-mentioned treating liquids are effective not only for forming the hydrated chromium oxide layer on the plated nickel base layer surface, but also, for removing an oxide film formed on the surface of the plated nickel base layer. Therefore, for the purpose of removing the oxide film, the nickel-plated steel strip may be immersed in the treating liquid or may be subjected to an anodic electrolytical treatment, before the cathodic electrolytical treatment.

When the concentration of the chromium compound in the treating liquid is less than 1 g/l, sometimes, the oxide film may not be satisfactorily removed from the plated nickel layer surface, and it may be difficult to provide a uniform hydrated chromium oxide layer. Also, even if the concentration of the chromium compound in the treating liquid is increased to more than 150 g/l, the excessive portion of the chromium compound above 150 g/l is not effective for enhancing the effect of the hydrated chromium oxide layer. The excessive concentration makes the treating process uneconomical, because a large amount of the chromium compound is removed from the treating bath by the steel strip passing through the bath. This phenomenon is called a drag out.

In the formation of the hydrated chromium oxide-containing coating layer on the plated nickel layer, a cathodic electrolytic treatment in which the nickel-plated steel strip serves as a cathode, is carried out under the following treating conditions which are variable in response to the purpose of the treatment and the composition of the treating liquid used.

(A) In the case where a treating liquid containing an aqueous solution of chromic anhydride, chromate, dichromate or a mixture of two or more of the above-mentioned compounds, and optionally containing anions such as $SO^{-4}$ which are unavoidable impurities of the above-mentioned compounds, is used, it is necessary to adjast the pH of the treating liquid to a specific value.

In the case where the $SO_4^{-2}$ compound in an amount of 1/40 or less based on the weight of the $Cr^{+6}$ compound and/or the F-compound in an amount of 1/10 or less based on the weight of the $Cr^{+6}$ compound, are positively added to the treating liquid, the cathodic electrolytic treatment is carried out at a pH of 1.5 or more, using a quantity of electricity of from 0.5 to 75 coulombs/dm$^2$. In this case, the current density to be applied to the electrolytic treatment is not limited to a specific value thereof. If the quantity of electricity applied is less than 0.5 coulombs/dm$^2$, the amount of the resultant coating layer is unsatisfactory and, therefore, the properties of the resultant product are unsatisfactory. A quantity of electricity above 75 coulombs/dm$^2$ is not effective for enhancing the effect of the coating layer. The excessive quantity of electricity not only makes the heating process uneconomical, but also, causes the surface of the coating layer to be discolored, and, therefore, the commercial value of the product to be lowered.

The treating time is not limited to a specific value as long as the quantity of electricity is maintained at an adequate value while the treatment is taking place. That is, the treatment can be finished when the amount of the coating layer reaches a desired value.

After the electrolytic treatment is completed, the surface of the resulting coating layer is rinsed with water so as to remove a residual amount of the treating liquid from the product which is then dried.

In the present invention, by forming a coating layer composed of a metallic chromium underlayer and a hydrated chromium oxide apper layer, on the plated nickel layer surface, the resistance to corrosion of the product can be enhanced and the formation of the pin holes in the coating layer can be decreased.

The above-mentioned layered coating layer can be prepared by the following method (B).

(B) In this method, a cathodic electrolytic treatment is carried out by using a treating liquid containing an aqueous solution of chromic anhydride, chromate, dichromate or a mixture of two or more of the above-mentioned compounds, the $SO_4^{-2}$ compound in an amount of 1/40 based on the weight of the $Cr^{+6}$ compound and/or the $F^-$ compound in an amount of 1/10 based on the weight of the $Cr^{+6}$ compound, at a pH less than 1.5, at a current density of from 7.5 to 25 A/dm$^2$ at a quantity of electricity of 2.5 coulombs/dm$^2$.

The metallic chromium underlayer is significantly effective for enhancing the resistance of the product to corrosion. However, since the metallic chromium has an extremely high melting point of 1903° C., a high hardness and a remarkably large electric resistance in comparison with that of metallic nickel, the metallic chromium underlayer results in a decrease in the weldability of the product. That is in order to prevent forming splashes in the weld and to provide a uniform weld nuggets in the electric resistance welding process, the weight of the metallic chromium underlayer is preferably limited to 10 mg or less, more preferably, 5 mg or less, per m$^2$ of each surface of the steel strip substrate.

Next, the hydrated chromium oxide upper layer is formed on the underlayer in the manner as mentioned above. In this case, it is preferable that the sum of the weight of the upper layer and the underlayer is in the range of from 2 to 20 mg, in terms of metallic chromium, per m$^2$ of each surface of the steel strip substrate. This feature is contributory to imparting a satisfactory weldability to the product.

The metallic chromium underlayer and the hydrated chromoium oxide upper layer may be produced by using the same single treating liquid. Otherwise, after the metallic chromium underlayer is formed by using a treating liquid, the hydrated chromium oxide upper layer is formed by using another treating liquid.

In the formation of a layer consisting of the hydrated chromium oxides alone, it is preferable that the electrolytic treating liquid contains $SO_4^{-2}$ and/or $F^-$ ions. The $SO_4^{-2}$ and/or $F^-$ ions are effective for forming an extremely thin layer of metallic chromium, which amount is very difficult to measure at the present level of scientific technology, on the plated nickel base layer surface. This thin layer of metallic chromium is effective for reducing the number of pin holes in the hydrated chromium oxide layer.

The cause of the above-mentioned phenomenon is not completely clear. However, the cause is assumed to be as follows. The nickel plating procedure is carried out by using a plating liquid containing $SO_4^{-2}$ ions. After the plating procedure is completed, the surface of the plated nickel layer is rinsed with water. However, a small amount of $SO_4^{-2}$ ions are retained in the pin holes in the plated nickel layer. When the chromate electrolytic treating liquid contains $SO_4^{-2}$ and/or $F^-$ ions, the $SO_4^{-2}$ and/or $F^-$ ions in the treating liquid cooperate with the $SO_4^{-2}$ ions in the pin holes so as to allow the metallic chromium to be deposited in the pin holes in the plated nickel base layer.

Accordingly, by using the electrolytic treating liquid containing $SO_4^{-2}$ and/or $F^-$ ions, it becomes possible to form a single hydrated chromium oxide layer having the same effect in enhancing the corrosion resistance as that of the coating layer composed of the metallic chromium underlayer and the hydrated chromium oxide upper layer.

The method for producing the coating layer consisting essentially of hydrated chromium oxides alone, is not limited to the above-mentioned types of cathodic electrolytic treating methods. The single hydrated chromium oxide layer may be provided by a conventional immersing method, spraying method or blowing method.

The weldability, lacquer-bonding property and corrosion resistance-enhancing property of the hydrated chromium oxide layer can be improved by adjusting the molar ratio of the Cr-O type oxo bonds to the Cr-OH type ol bonds in the outermost surface of the hydrated chromium oxide layer to 0.85 or more, preferably, 0.90 or more.

The molar ratio, oxo bond/ol bond, can be determined by an Auger spectroanalysis, in which a height ($H_1$) of a Cr Auger peak from the background thereof is measured, a difference ($H_2$) between the largest height of a Cr-peak of a type of chromium oxide and the smallest height of another Cr-peak of another type of chromium oxide, is measured, and the molar ratio, oxo bond/ol bond, is represented by a ratio of $H_1/H_2$.

Usually, the chromate (hydrated chromium oxides) layer prepared by the conventional electrolytic chromate treating method contains $Cr^{+6}$ and $SO_4^{-2}$ and/or $Fe^-$ which are water soluble. Accordingly, by removing the water-soluble substances from the hydrated chromium oxide layer and by dehydrating and condensing the colloidal hydrated chromium oxides, the molar ratio, oxo bonds/ol bonds, can be increased to 0.85 or more, preferably, 0.90 or more. The resultant hydrated chromium oxide layer surface has a decreased degree of hydration and a crystal-like structure. This type of the hydrated chromium oxide layer surface is remarkably contributory to enhancing the weldability, lacquer-bonding property, resistance to corrosion and resistance to corrosion under the lacquer coating, of the product. Especially, the above-mentioned type of hydrated chromium oxide layer allows the welding current to easily, uniformly flow therethrough, and therefore, makes the welding procedure possible to be carried out under a wide range of welding conditions, under which nuggets are formed uniformly and the resultant weld exhibits a satisfactory welding strength.

Furthermore, the resistance of the hydrated chromium oxide-coated steel strip of the present invention to corrosion under the lacquer coating can be enhanced by limiting the atomic ratio of sulfur or fluorine atoms to oxygen atoms in the uppermost chromium layer to 0.15 or less, more preferably, to 0.10 or less. This atomic ratio can be measured by means of an Auger spectroanalysis or fluorescent X-ray analysis (X-ray fluorometry).

When the atomic ratio is 0.15 or less, that is, the content of the water-soluble substances in the hydrated chromium oxide outermost surface layer is very small, the amount of the water-soluble substances which flows out from the hydrated chromium oxide layer through the lacquer coating, when the lacquer coated steel strip is contact with a corrosive aqueous liquid for a long period of time, is very small. Therefore practically no blisters, or very small blisters are formed on the lacquer coating. Therefore, substantially no separation of the lacquer coating from the hydrated chromium oxide outermost surface occurs.

In order to adjust the molar ratio, the oxo bond/ol bond, the 0.85 or more, the hydrated chromium oxide-coated steel strip which has just been treated with a cathodic electrolytic chromate treating liquid and rinsed with water, is treated with hot water at a tmperature of from 65° to 100° C., preferably, from 75° to 95° C., at a pH of from 4.0 to 10.0, preferably, from 6 to 9 for from 0.3 seconds to 10 seconds. The pH of the hot water can be adjusted by using ammonium carbonate or sodium carbonate. This hot water treatment causes the water-soluble $SO_4^{-2}$ and/or $F^-$ and $Cr^{+6}$ compounds to be removed from the hydrated chromium oxide outermost surface layer and the colloidal $Cr^{+3}$ hydroxide to be hydrated and condensed. After the hot water treatment, the content of the water soluble substance in the hydrated chromium oxide outermost surface layer is very small and, therefore, the hydrated chromium oxide layer exhibits an extremely small degree of hydration and a high molar ratio of oxo bonds to ol bonds.

In order to obtain a high molar ratio, oxo bond/ol bond, of 0.85 or more and a low atomic ratio of sulfur or fluorine atoms to oxygen atoms, of 0.15 or less, it is preferably that the concentration of $SO_4^{-2}$ ions and $F^-$ in the cathodic electrolytic treating liquid is 1/40 or less, more preferably, 1/50 or less, and 1/10 or less, more preferably, 1/40 or less, based on the weight of $Cr^{+6}$ therein, respectively. An excessively large concentration of $SO_4^{-2}$ or $F^-$ ions causes the removal thereof with hot water to be difficult and the resultant product exhibits an unsatisfactory resistance to corrosion under the lacquer coating.

The hot water treatment may be carried out by immersing the chromate-coated steel strip in water, by spraying hot water to the hydrated chromium oxide-coated steel strip or by blowing a mixture of a high temperature steam with cold water on the hydrated chromium oxide-coated steel strip.

The hydrated chromium oxide-coated steel strip of the present invention may have an additional plated tin intermediate layer provided between the plated nickel base layer and the hydrated chromium oxide containing coating layer. The intermediate layer has a weight of from 100 to 2000 mg, more preferably, from 300 to 1000 mg, per $m^2$ of each surface of the steel strip substrate.

The plated tin intermediate layer having a relatively low melting point is effectively broadens the scope of the electric resistance welding condition so that uniform nuggets are easily formed.

The tin layer is also effective for enhancing resistance to corrosion, because the metallic tin exhibits an anodic corrosion-preventing effect on the plated nickel layer when the coated steel strip is brought into contact with a corrosive liquid, for example, an aqueous solution containing citric acid.

When the tin layer is subjected to a heat-melting treatment, a Ni-Sn alloy layer is formed between the tin layer and the nickel layer. This Ni-Sn alloy layer is effective for enhancing the resistance of the product to corrosion. The heat-melting treatment is preferably carried out at a temperature of from 240° to 350° C., more preferably, from 250° to 300° C.

In the above-mentioned type of hydrated chromium oxide-coated steel strip of the present invention, the tin intermediate layer is effective for preventing the formation of an Fe-Sn alloy layer consisting mainly of an $FeSn_2$ alloy, in the heat-affected zone in or around the weld, when an electric resistance welding procedure is applied to the coated steel strip. This is because the plated tin layer is separated from the steel strip substrate through the plated nickel layer. If the tin layer is formed directly on the steel strip substrate surface, the electric resistance welding procedure applied to the coated steel strip results in the undesirable formation of an $FeSn_2$ alloy layer. This $FeSn_2$ layer causes the weld to be discolored and the appearance of the weld to be poor and the lacquer-bonding property and the resistance to corrosion under the lacquer coating to be significantly degraded.

In the hydrated chromium oxide-coated steel strip having the plated tin intermediate layer, the Sn-Ni alloy layer formed between the nickel layer and the tin layer enhances the resistance to corrosion and weldability of the resultant product.

The tin layer may be formed by any conventional tin layer-forming method. Also, the hydrated chromium oxide-containing coating layer of the present invention can be produced by the afore-described methods.

SPECIFIC EXAMPLES

The following specific examples are presented for the purpose of clarifying the present invention. However, it should be understood that these are intended only to be examples of the present invention and are not intended to limit the present invention in any way.

In the examples, the properties of the products were measured as follows.

(1) Pin hole-preventing property

The degree of the formation of pin holes in the product was evaluated in such a manner that after the product was cleaned up with a concentrated $H_2SO_4$ solution, the cleaned product was immersed in a 5% aqueous solution of $CuSO_4.5H_2O$ at a temperature of 50° C. for one minute, and the amount of metallic copper deposited on the product surface was determined.

(2) Weldability

Two pieces of the products were welded by an electric resistance welding method while moving copper wire electrodes along the weld. The welder used was an FBB type welding machine made by Soudronic Co. The welding procedure was carried out under the following conditions.

Speed of Can-production: 450 cans/min.
Speed of Wire electrode: 50 m/min.
Welding pressure: 36 kg
Welding current: adjusted to a desired value by controlling the height of the current peak and the wave form.

The adequate welding current range, in which no splash was produced and in which the resultant weld exhibited a satisfactory appearance and welding strength, was determined, for each product to be welded, by changing the welding current.

The welding strength of the weld was determined by a conical cup test in which a welded can was expanded so that the diameter of the can increased 20% above the original diameter thereof, and the peeling strength of the weld was measured. When no peeling occured, the welding strength of the welded can was evaluated as satisfactory.

The appearance of the weld was evaluated by counting the number of sprashes formed on the weld surface.

(3) Lacquer-bonding propertis

A coating film having a thickness of 4.5 microns was formed on the product surface by using an epoxyphenol type lacquer. The lacquer-coated product was immersed in an aqueous solution containing 1.5% by weight of NaCl and 1.5% by weight of citric acid and saturated with air, for 96 hours. The lacquer-bonding strength of the above-mentioned product was measured by a cross cut test.

The resistance of the product to corrosion under the lacquer coating was measured by the same procedures as those mentioned above, except that the lacquer coating layer was scratched, the scratched lacquer coating was immersed in the same treating liquid as that described above, and the intensity of corrosion of the scratched portion was evaluated.

EXAMPLE 1

A cold rolled steel strip having a thickness of 0.21 mm was degreased and pickled by a usual method.

The pickled steel strip was subjected to a nickel electroplating process by using a plating liquid containing 240 g/l of $NiSO_4 \cdot 6H_2O$, 30 g/l of $NiCl_2 \cdot 6H_2O$ and 30 g/l of $H_3BO_3$, at a current density of 10 A/dm$^2$.

The resultant plated nickel layer had a weight of 600 mg per m$^2$ of each surface of the steel strip substrate surface.

Next, the nickel plated steel strip was subjected to a cathodic electrolytic chromate treatment by using an aqueous solution of 50 g/l of $CrO_3$, at a temperature of 55° C., at a current density of 10 A/dm$^2$ for 4 seconds. The resultant hydrated chromium oxide coating layer had a weight of 7.5 mg, in terms of metallic chromium, per m$^2$ of each surface of the steel strip substrate.

The resultant product was rinsed with water and, then, subjected to the above-mentioned tests without applying a hot water treatment thereto.

The results of the tests are indicated in Table 1.

EXAMPLE 2

The same procedures as those described in Example 1 were carried out with the following exceptions.

In the nickel plating procedure, the current density was 20 A/dm$^2$ and the resultant plated nickel layer had a weight of 450 mg/m$^2$.

In the cathodic electrolytic chromate treatment, the treating aqueous solution contained 0.2 g/l of $SO_4^{-2}$ in addition to 50 g/l of $CrO_3$ and had a temperature of 60° C. and the treatment was carried out at a current density of 5 A/dm$^2$ for 5 seconds. The resultant hydrated chromium oxide layer was of a weight of 6 mg/m$^2$ in terms of metallic chromium.

The results are indicated in Table 1.

EXAMPLE 3

The same procedures as those described in Example 1 were carried out with the following exceptions.

The nickel-plating procedure was carried out by using an aqueous solution containing 300 g/l of nickel sulfamate and 30 g/l of $H_3BO_3$, at a current density of 30 A/dm$^3$. The resultant plated nickel layer was of the weight of 500 mg/m$^2$.

The chromate treatment was carried out by using an aqueous solution containing 50 g/l of $CrO_3$ and 0.2 g/l of $SO_4^{-2}$, at a temperature of 65° C. at a current density of 6 A/dm$^2$ for 5 seconds. The resultant hydrated chromioum oxide coating layer had a weight of 5.8 mg/m$^2$, in terms of metallic chromium.

The water-rinsed chromate-treated steel strip was treated by spraying a distilled water having a temperature of 80° C. and a pH of 6.2 thereto for 5 seconds.

The results are indicated in Table 1.

EXAMPLE 4

The same procedures as those described in Example 3 were carried out with the following exceptions.

In the nickel-plating procedure, the current density was 15 A/dm$^2$ and the weight of the resultant plated nickel layer was 400 mg/m$^2$.

The chromate treatment was carried out by using an aqueous solution containing 75 g/l of $(NH_4)_2CrO_4$ and 0.3 g/l of NaF, at a temperature of 50° C., at a current density of 5 A/dm$^2$ for 6 seconds. The weight of the resultant hydrated chromium oxide coating layer was 5.5 mg/m$^2$, in terms of metallic chromium.

The water-rinsed coated steel strip was immersed in city water having a pH of 7.8 adjusted by using ammonium carbonate, at a temperature of 95° C. for 3 seconds.

The results are indicated in Table 1.

EXAMPLE 5

The same procedures as those described in Example 1 were carried out with the following exceptions.

The nickel-plating procedure was carried out by using an aqueous solution containing 300 g/l of $NiSO_4$ $6H_2O$, 35 g/l of $NiCl_2 \cdot 6H_2O$ and 25 g/l of $H_3BO_3$, at a current density of 15 A/dm$^2$. The weight of the resultant nickel layer was 300 mg/m$^2$.

The chromate treatment was carried out by using an aqueous solution containing 80 g/l of $CrO_3$ and 0.6 g/l of $SO_4^{-2}$, at a temperature of 50° C. at a current density of 15 A/dm$^2$ for one second. After water-rinsing, the resultant hydrated chromium oxide-containing coating layer was composed of 3 mg/m$^2$ of a metallic chromium underlayer and 4.5 mg/m$^2$ in terms of metallic chromium, of a hydrated chromium oxide upper layer.

The results are indicated in Table 1.

EXAMPLE 6

The same procedures as those described in Example 5 were carried out with the following exceptions.

After being rinsed with water, the resultant coated steel strip was immersed in city water adjusted to a pH of 7.5 by using sodium carbonate and to a temperature of 90° C., for 3 seconds.

The results are indicated in Table 1.

EXAMPLE 7

The same procedures as those described in Example 5 were carried out, with the following exceptions.

The chromate treatment was carried out by using an aqueous solution containing 80 g/l of $CrO_3$ and 0.8 g/l of $SO_4^{-2}$, at a temperature of 60° C. at a current density of 20 A/dm$^2$ for 0.5 seconds. After water-rinsing, the resultant hydrated chromium oxide-containing coating layer was composed of 5 mg/m$^2$ of a metallic chromium underlayer and 10 mg/m$^2$, in terms of metallic chromate, of a hydrated chromium oxide upper layer.

The hydrated chromium oxide-coated steel strip was subjected to a hot water treatment in which distilled water having a temperature of 80° C. and a pH of 8.1 adjusted by using ammonium carbonate, was sprayed on the steel strip for 3.5 seconds.

The results are indicated in Table 1.

EXAMPLE 8

The same procedures as those described in Example 5 were carried out, with the following exceptions.

The nickel plating procedure was carried out by using an aqueous solution of 350 g/l of $NiSO_4 \cdot 6H_2O$, 30 g/l of $H_3BO_3$, at a current density of 35 A/dm$^2$. The weight of the plated nickel layer was 700 mg/m$^2$.

The chromate treatment was carried out by using an aqueous solution containing 90 g/l of $CrO_3$, 0.6 g/l of $NH_4F$, 3.3 g/l of $Na_2SiF_6$ and 0.08 g/l of $SO_4^{-2}$, at a temperature of 40° C. at a current density of 15 A/dm$^2$ for 0.75 seconds. The resultant water-rinsed, hydrated chromium oxide-coated steel strip was composed of 3.5 mg/m$^2$ of a metallic chromium underlayer and 4.2 mg/m$^2$, in terms of metallic chromium, of a hydrated chromium oxide upper layer.

The results are indicated in Table 1.

EXAMPLE 9

The same procedures as those described in Example 8 were carried out with the following exceptions.

In the nickel-plating procedures, the current density was 10 A/dm$^2$ and the weight of the resultant plated nickel layer was 380 mg/m$^2$.

After water-rinsing, the resultant hydrated chromium oxide-coated steel strip was immersed in city water having a pH of 7.4 adjusted by using ammonia, at a temperature of 95° C. for 5 seconds.

The results are shown in Table 1.

COMPARATIVE EXAMPLE 1

The same procedures as those described in Example 1 were carried out with the following exceptions.

The plated nickel layer had a weight of 100 mg/m$^2$.

The chromate treatment was carried out in the same manner as that described in Example 2. The weight of the hydrated chromium oxide coating layer was 6 mg/m$^2$, in terms of metallic chromium.

The results are indicated in Table 1.

COMPARATIVE EXAMPLE 2

The same procedures as those described in Example 1 were carried out with the following exception.

The chromate treatment was carried out by using the same aqueous solution as that described in Example 2, except that the weight of the resultant hydrated chromium oxide coating layer was 30 mg/m$^2$ in terms of metallic chromium.

The hydrated chromium oxide-coated steel strip was treated with hot water in the same manner as that mentioned in Example 3.

The results are shown in Table 1.

COMPARATIVE EXAMPLE 3

The same procedures as those described in Example 7 were carried out, with the following exception.

The nickel plating procedure was carried out in the same manner as that described in Example 1, except that the weight of the plated nickel layer was 80 mg/m$^2$.

In the chromate treatment, the resultant hydrated chromium oxide-containing coating layer was composed of 5 mg/m$^2$ of a metallic chromium underlayer and 10 mg/m$^2$, in terms of metallic chromium, of a hydrated chromium oxide upper layer.

The results are shown in Table 1.

COMPARATIVE EXAMPLE 4

The same procedures as those described in Example 7 were carried out, with the following exception.

The nickel plating procedure was conducted in the same manner as that mentioned in Example 5, except that the weight of the plated nickel layer was 500 mg/m$^2$.

The chromate treatment was carried out by changing the treating time period so that the resultant hydrated chromium oxide-containing coating layer was composed of 15 mg/m$^2$ of a metallic chromium underlayer and 10 mg/m$^2$, in terms of metallic chromate, of a hydrated chromium oxide upper layer.

The results are indicated in Table 1.

COMPARATIVE EXAMPLE 5

The same procedures as those described in Example 8 were carried out with the following exceptions.

In the nickel plating procedure, the weight of the resultant plated nickel layer was 300 mg/m$^2$.

The chromate treatment was carried out in the same manner as that described in Example 5, except that the treating time was changed so as to cause the resultant hydrated chromium oxide-containing coating layer to be composed of 5 mg/m$^2$ of a metallic chromium underlayer and 25 mg/m$^2$, in terms of metallic chromium, of a hydrated chromium oxide upper layer.

The results are indicated in Table 1.

EXAMPLE 10

The same type of cold-rolled steel strip as that described in Example 1 was electro plated with nickel by using a plating liquid containing 300 g/l of $NiSO_4 \cdot 6H_2O$; 35 g/l of $NiCl \cdot 6H_2O$ and 25 g/l of $H_3BO_3$, at a current density of 4 A/dm$^2$ for 6 seconds. The resultant plated nickel layer had a weight of 700 mg/m$^2$.

The nickel plated steel strip was plated with tin by using a plating solution containing 60 g/l of $SnSO_4$, 15 g/l, in terms of sulfonic acid, of phenol sulfonic acid and 10 g/l of ethoxylated $\alpha$-naphtol sulfonic acid (ENSA), at a current density of 20 A/dm$^2$ for 0.1 seconds. The weight of the resultant plated tin layer was 100 mg/m$^2$. Without applying a heat-melting treatment to the tin layer, the tin-plated steel strip was treated with chromate by using a treating solution containing 30 gl of $Na_2Cr_2O_7 \cdot 2H_2O$, at a temperature of 45° C., at a current density of 15 A/dm$^2$ for 0.4 seconds. The weight of the resultant hydrated chromium oxide coating layer was 10 mg/m$^2$ in terms of metallic chromium.

The hydrated chromium oxide-coated steel strip was treated with hot water in the same manner as that described in Example 4.

The results are indicated in Table 2.

EXAMPLE 11

The same type of cold-rolled steel strip as that described in Example 1 was plated with nickel by using a plating solution containing 30 g/l of nickel sulfamate and 30 g/l of $H_3BO_3$, at a current density of 30 A/dm$^2$. The weight of the resultant plated nickel layer was 500 mg/m$^2$.

The nickel plated steel strip was plated with tin by using a plating solution containing 75 g/l of $SnCl_2$, 25 g/l of NaF, 50 g/l of KHF, 45 g/l of NaCl and 2 g/l of naphthol sulfonic acid, at a current density of 50 A/dm$^2$. The weight of the plated tin layer was 300 mg/m$^2$.

Without applying a heat-melting treatment to the tin layer, a chromate treatment was applied to the tin-plated steel strip by using a treating solution containing 10 g/l of $CrO_3$, at a temperature of 80° C. at a current

TABLE 1

| Example No. | Pin hole-preventing property | Property of hydrated chromium oxide layer: Atomic ratio S/O | Atomic ratio F/O | Molar ratio oxo/Ol | Electric resistance weldability: Adequate welding range | Welding strength of weld | Appearance of weld | Lacquer bonding property: Lacquer-bonding strength | Resistance to corrosion under lacquer coating |
|---|---|---|---|---|---|---|---|---|---|
| Example | | | | | | | | | |
| 1 | satisfactory | 0.12 | — | 0.80 | good | excellent | excellent | good | good |
| 2 | good | 0.18 | — | 0.81 | " | " | " | " | " |
| 3 | excellent | 0.10 | — | 0.88 | excellent | " | " | excellent | excellent |
| 4 | " | — | 0.09 | 0.92 | " | " | " | " | " |
| 5 | " | 0.15 | — | 0.83 | good | " | " | " | " |
| 6 | " | 0.05 | — | 0.95 | excellent | " | " | " | " |
| 7 | " | 0.07 | — | 1.02 | " | " | " | " | " |
| 8 | " | 0.01 | 0.14 | 0.88 | good | " | " | " | " |
| 9 | " | — | 0.11 | 1.05 | excellent | " | " | " | " |
| Comparative Example | | | | | | | | | |
| 1 | poor | 0.18 | — | 0.84 | satisfactory | " | good | poor | poor |
| 2 | satisfactory | 0.19 | — | 0.80 | poor | poor | poor | satisfactory | good |
| 3 | poor | 0.07 | — | 1.03 | satisfactory | excellent | satisfactory | poor | poor |
| 4 | excellent | 0.06 | — | 1.02 | poor | poor | poor | excellent | excellent |
| 5 | excellent | 0.17 | — | 0.82 | poor | poor | poor | satisfactory | good |

density of 10 A/dm$^2$ for 0.5 seconds. The weight of the resultant hydrated chromium oxide layer was 4 mg/m$^2$, in terms of metallic chromium.

No hot water treatment was applied to the hydrated chromium oxide-coated steel strip.

The results are indicated in Table 2.

EXAMPLE 12

The same procedures as those described in Example 10 were carried out with the following exception.

The weight of the plated nickel layer was 250 mg/m$^2$. The weight of the plated tin layer was 550 mg/m$^2$.

The heat-melting treatment was carried out in the following manner. An aqueous solution containing 4 g/l of $SnSO_4$ and 4 g/l, in terms of sulfonic acid, of phenol sulfonic acid, was coated as a flux on the plated tin layer surface. The flux-coated steel strip was rapidly heated to 260° C. by an electric heating method, and, then, rapidly cooled with water, to make it lustrous.

The heat-melting treated steel strip was coated with chromate by using a treating solution containing 80 g/l of $(NH_4)_2CrO_4$, at a temperature of 60° C. at a current density of 10 A/dm$^2$. The weight of the hydrated chromium oxide coating layer was 15 mg/m$^2$, in terms of metallic chromium. No hot water treatment was applied to the product.

EXAMPLE 13

The same procedures as those described in Example 11 were carried out, with the following exception.

The weight of the plated nickel layer was 150 mg/m$^2$. The weight of the plated tin layer was 700 mg/m$^2$.

The tin-plated steel strip was rapidly heated to a temperature of 280° C. by an electric heating method without using a flux, and, rapidly cooled with water to make it lustrous.

The chromate treatment was carried out by using a treating solution containing 30 g/l of $(NH_4)_2Cr_2O_7$, at a temperature of 45° C. at a current density of 12 A/dm$^2$ for 1.2 seconds. The weight of the hydrated chromium oxide coating layer was 12 mg/m$^2$, in terms of metallic chromium.

The hydrated chromium oxide-coated steel strip was treated with hot water in the same manner as mentioned in Example 4.

The results are indicated in Table 2.

COMPARATIVE EXAMPLE 6

The same procedures as those described in Example 10 were carried out, with the following exception.

No nickel plating procedure was applied to the steel strip.

The weight of the plated tin layer was 150 mg/m$^2$.

No hot water treatment was carried out.

The results are indicated in Table 2.

COMPARATIVE EXAMPLE 7

The same procedures as those described in Example 12 were carried out, with the following exception.

No nickel plating was carried out.

The tin plating procedure was carried out in the same manner as that described in Example 10.

The weight of the resulted plated tin layer was 1600 mg/m$^2$.

The results are indicated in Table 2.

COMPARATIVE EXAMPLE 8

The same procedures as those described in Example 10 were carried out, with the following exception.

The weight of the plated nickel layer was 25 mg/m$^2$.

The weight of the plated tin layer was 500 mg/m$^2$.

The heat-melting treatment was carried out in the same manner as that described in Example 12.

Also, the chromate treatment was effected in the same manner as that described in Example 12.

The hot water treatment was conducted in the same manner as that described in Example 4.

The results are indicated in Table 2.

COMPARATIVE EXAMPLE 9

The same procedures as those described in Example 11 were carried out, with the following exceptions.

The weight of the plated nickel layer was 10 mg/m$^2$.

The weight of the plated tin layer was 30 mg/m$^2$.

The chromate treatment was carried out in the same manner as that described in Example 13.

The hydrated chromium oxide-coated steel strip was subjected to the same hot water treatment as that mentioned in Example 4.

The results are indicated in Table 2.

TABLE 2

| | Pin hole- | Hydrated chromium oxide layer | | Electric resistance weldability | | | Lacquer-bonding property | |
|---|---|---|---|---|---|---|---|---|
| Example No. | preventing property | Atomic ratio S/O | Molar ratio oxo-bond/ol bond | Adequate welding range | Welding strength of weld | Appearance of weld | Lacquer-bonding strength | Resistance to corrosion under lacquer coating |
| Example | | | | | | | | |
| 10 | Excellent | 0.04 | 0.88 | Excellent | Excellent | Excellent | Excellent | good |
| 11 | " | 0.06 | 0.82 | " | " | " | " | " |
| 12 | " | 0.04 | 0.83 | " | " | " | " | " |
| 13 | " | 0.03 | 0.87 | " | " | " | " | " |
| Comparative Example | | | | | | | | |
| 6 | poor | 0.05 | 0.83 | Satisfactory | " | poor | poor | poor |
| 7 | good | 0.04 | 0.83 | " | " | " | Excellent | good |
| 8 | " | 0.04 | 0.87 | " | " | " | " | " |
| 9 | poor | 0.03 | 0.89 | " | " | " | poor | poor |

As shown in Tables 1 and 2, the products of Comparative Examples 1 through 9 are unsatisfactory in weldability, especially, the appearance of weld, whereas all the products of Examples 1 through 13 exhibit satisfactory weldability and lacquer-bonding properties.

We claim:

1. A can or container having a welded seam and fabricated from a hydrated chromium oxide-coated steel strip consisting essentially of:

a steel strip substrate having two surfaces;

plated nickel base layers formed on the surfaces of said steel strip substrate and consisting essentially of metallic nickel in an amount of from 150 to 2500 mg per $m^2$ on each surface of said steel strip substrate, and;

hydrated chromium oxide-containing coating layers formed on said plated nickel based layers and composed of an underlayer consisting of metallic chromium in an amount of 10 mg or less per $m^2$ of each surface of said steel strip substrate, and an upper layer consisting of hydrated chromium oxides, the sum of the weights of said underlayer and said upper layer being in the range of 2 to 20 mg, in terms of metallic chromium per $m^2$ of each surface of said steel strip substrate.

2. The welded can or container of claim 1 free from staining, discoloring or both on the weld surface.

3. The welded can or container of claim 1 adapted for lacquer bonding and resistant to corrosion under a lacquer coating.

4. The welded can or container of claim 1 in which the seam is closed by electric resistance welding.

5. A welded can or container having a welded seam, said container fabricated from a hydrated chromium oxide-coated steel strip consisting essentially of:

a steel strip substrate having two surfaces:

plated nickel base layers formed on the surfaces of said steel strip substrate and consisting of metallic nickel in a weight of from 150 to 2500 mg per $m^2$ of each surface of said steel strip substrate;

hydrated chromium oxide-containing coating layers formed on said plated nickel base layers and composed of an underlayer consisting of metallic chromium in a weight of 10 mg or less per $m^2$ of each surface of said steel strip substrate, and an upper layer consisting of hydrated chromium oxides, the sum of the weights of said underlayer and said upper layer being in the range of from 2 to 20 mg, in terms of metallic chromium, per $m^2$ of each surface of said steel strip substrate; and a plated tin intermediate layer formed between said plated nickel base layer and said hydrated chronium oxide-containing coating layer, the weight of said tin layer being in the range of from 100 to 2000 mg per $m^2$ of each surface of said steel strip substrate.

* * * * *